US011573028B2

(12) United States Patent
Reardon et al.

(10) Patent No.: US 11,573,028 B2
(45) Date of Patent: Feb. 7, 2023

(54) HEATER ASSEMBLY OF A HEATING UNIT

(71) Applicant: Johnson Controls Technology Company, Auburn Hills, MI (US)

(72) Inventors: Anthony J. Reardon, Moore, OK (US); Praveen M. Gotakhindi, Pune (IN); Sriram Ramanujam, Pune (IN); Karan Garg, Pune (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 263 days.

(21) Appl. No.: 16/434,007

(22) Filed: Jun. 6, 2019

(65) Prior Publication Data

US 2020/0378644 A1 Dec. 3, 2020

Related U.S. Application Data

(60) Provisional application No. 62/856,543, filed on Jun. 3, 2019.

(51) Int. Cl.

| | |
|---|---|
| ***F24F 11/89*** | (2018.01) |
| ***F24F 11/70*** | (2018.01) |
| ***F24F 1/06*** | (2011.01) |
| ***F24F 5/00*** | (2006.01) |

(52) U.S. Cl.

CPC ..... *F24F 11/89* (2018.01); *F24F 1/06* (2013.01); *F24F 5/001* (2013.01); *F24F 11/70* (2018.01); *F24F 2221/12* (2013.01); *F24F 2221/36* (2013.01)

(58) Field of Classification Search

CPC .. F24H 9/2071; F24H 3/0405; F24F 2221/34; F24F 2221/54; F24F 11/70

See application file for complete search history.

(56) References Cited

U.S. PATENT DOCUMENTS

| | | | | |
|---|---|---|---|---|
| 7,064,301 | B2 * | 6/2006 | Han | F24H 3/0405 219/202 |
| 7,823,402 | B2 | 11/2010 | Hayashida et al. | |
| 9,234,677 | B2 * | 1/2016 | Clade | F24H 3/0441 |
| 2005/0132737 | A1 * | 6/2005 | Jeon | F24F 1/0007 62/298 |
| 2005/0175328 | A1 * | 8/2005 | Pierron | F24H 9/1872 392/347 |
| 2009/0020515 | A1 * | 1/2009 | Clade | H05K 1/0203 219/202 |
| 2011/0237177 | A1 * | 9/2011 | Stewart | F24F 3/0442 454/338 |

(Continued)

FOREIGN PATENT DOCUMENTS

| | | |
|---|---|---|
| CN | 101876467 A | 11/2010 |
| JP | 2001327013 A | 11/2001 |

*Primary Examiner* — Lionel Nouketcha

(74) *Attorney, Agent, or Firm* — Fletcher Yoder, P.C.

(57) ABSTRACT

A heater assembly for a heating, ventilation, and/or air conditioning (HVAC) system has a heater and a controller enclosure. The heater has a plurality of heating elements in a frame that has two opposing ends. The controller enclosure has two end walls and a plurality of side walls in a non-rectangular polygonal configuration. One of the two opposing ends of the frame is coupled to one of the two end walls such that an orientation of the heating elements may be changed based on respective locations of the plurality of side walls of the controller enclosure.

23 Claims, 8 Drawing Sheets

(56) References Cited

U.S. PATENT DOCUMENTS

| | | | | |
|---|---|---|---|---|
| 2012/0062180 | A1* | 3/2012 | Nakamura | H01M 10/488 320/134 |
| 2015/0219386 | A1* | 8/2015 | Zinger | B23P 15/26 62/276 |
| 2018/0348600 | A1* | 12/2018 | Chan | H04N 5/23238 |
| 2019/0374935 | A1* | 12/2019 | Binder | F25D 29/005 |

* cited by examiner

HEATER ASSEMBLY OF A HEATING UNIT

CROSS-REFERENCE TO RELATED APPLICATIONS

This application claims priority from and the benefit of U.S. Provisional Application Ser. No. 62/856,543, entitled "HEATER ASSEMBLY OF A HEATING UNIT," filed Jun. 3, 2019, which is herein incorporated by reference in its entirety for all purposes.

BACKGROUND

HVAC systems are utilized in residential, commercial, and industrial environments to control environmental properties, such as temperature and humidity, for occupants of the respective environments. An HVAC system may control the environmental properties by controlling an air flow delivered to the environment. For example, a heating unit of the HVAC system may have multiple blowers configured to direct respective air flows through a heater assembly to condition each air flow delivered to the environment. A controller enclosure of the heater assembly may contain processing circuitry that regulates operation of a heater of the heater assembly to control the temperature of the air flows directed across the heater. The controller enclosure and the heater may be assembled into a specific orientation of the heater assembly before being transported to an installation site of the heating unit. In some instances, the transportation orientation of the heater assembly may be unstable, thereby increasing a potential for movement of the heater assembly and disturbance to the controller enclosure, the heater, or other components of the heater assembly during transit. As such, it may be desirable to increase the stability of the transportation orientation of the heater assembly during transit.

DRAWINGS

SUMMARY

Figure 1:
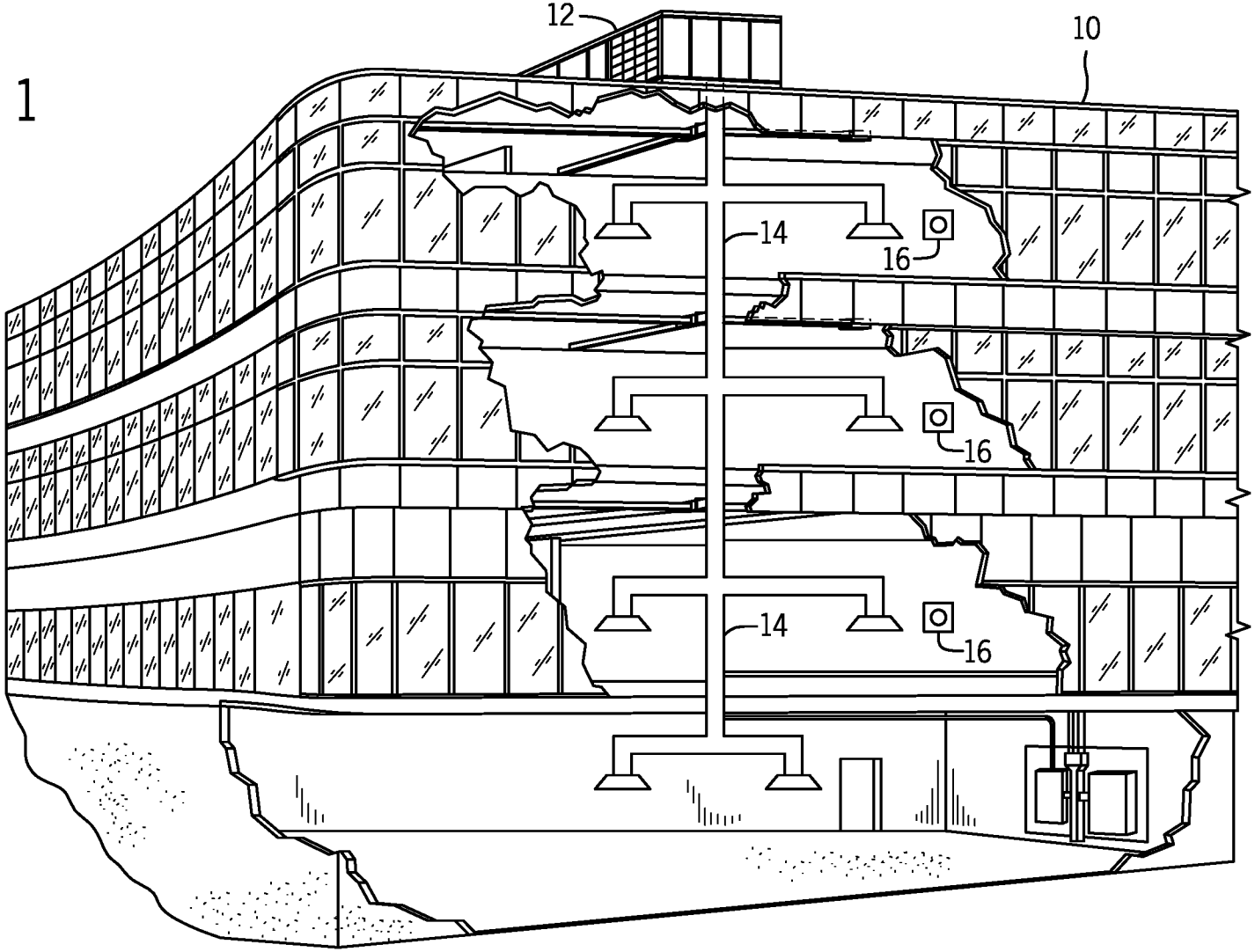
FIG. 1 is a schematic of an embodiment of an HVAC system for building environmental management that includes an HVAC unit, in accordance with an aspect of the present disclosure.

In one embodiment of the present disclosure, a heater assembly for a heating, ventilation, and/or air conditioning (HVAC) system has a heater and a controller enclosure. The heater has a plurality of heating elements in a frame that has two opposing ends. The controller enclosure has two end walls and a plurality of side walls in a non-rectangular polygonal configuration. One of the two opposing ends of the frame is coupled to one of the two end walls such that an orientation of the heating elements may be changed based on respective locations of the plurality of side walls of the controller enclosure.

In another embodiment of the present disclosure, a heater assembly for a heating, ventilation, and/or air conditioning (HVAC) system has a heater and a controller enclosure. The heater has a plurality of heating elements in a frame that has two opposing ends. The controller enclosure has two end walls and a plurality of side walls in a polygonal configuration. One of the two opposing ends of the frame is coupled to one of the two end walls. The frame has a base that is substantially aligned with a first side wall of the plurality of side walls of the controller enclosure such that the frame and the first side wall of the plurality of side walls are configured to rest on a flat surface.

In a further embodiment of the present disclosure, a heater assembly for a heating, ventilation, and/or air conditioning (HVAC) system has a heater and a controller enclosure. The heater has a plurality of heating elements in a frame that has two opposing ends. The controller enclosure has two end walls and a plurality of side walls in a non-rectangular polygonal configuration. One of the two opposing ends of the frame is coupled one of the two end walls. A first side wall of the plurality of side walls is a base of the controller enclosure and at least a second side wall and a third side wall of the plurality of side walls extend transverse to the first side wall.

Other features and advantages of the present application will be apparent from the following, more detailed description of the embodiments, taken in conjunction with the accompanying drawings which illustrate, by way of example, the principles of the application.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to an improved heater assembly of a heating, ventilation, and/or air conditioning (HVAC) system that may increase the stability of the heater assembly in a transportation orientation. For example, at a manufacturing facility, a controller enclosure, a heater, and other components may be assembled into the heater assembly. The heater assembly may then be transported to an installation site of the HVAC system and installed within a heating unit of the HVAC system. During transit to the installation site, the heater assembly may be disposed in a transportation orientation, for example, within a container, such as a box, or on a rack. In some instances, the transportation orientation of the heater assembly may be unstable, thereby increasing a potential for movement of the heater assembly and disturbance to the controller enclosure, the heater, or other components of the heater assembly during transit.

Accordingly, embodiments of the present disclosure are directed to an improved heater assembly that increases the stability of the heater assembly during transit. For example, the heater assembly may include a heater having a plurality of heating elements in a frame that has two opposing ends. The heater may be coupled to a controller enclosure formed from a plurality of housing panels that includes end walls and side walls. In some embodiments, the controller enclosure may have two end walls and a plurality of side walls in a polygonal configuration. For example, the polygonal configuration may be non-rectangular. One of the two opposing ends of the frame may be coupled to one of the two end walls such that an orientation of the heating elements may be changed based on respective locations of the plurality of side walls of the controller enclosure.

In a transportation orientation of the heater assembly, the heater of the heater assembly may be positioned parallel or substantially parallel to the ground. For example, the heater assembly may lie substantially flat or horizontally along the ground in a container, such as a box, or on a rack, such that at least a portion of the heater and at least a portion of a side wall of the controller enclosure may contact the ground or other surface supporting the heater assembly in the transportation orientation. In some embodiments, the frame of the heater has a base that is substantially aligned with the side wall of the controller enclosure such that the frame and the side wall may rest on a flat surface. With portions of the heater and the side wall in contact with supporting surfaces during transportation, the center of gravity of the heater assembly may be lowered, as compared to a heater assembly disposed at an oblique angle relative to the ground or other surface during transit. In this way, improved stability of the heater assembly during transportation is enabled and provided.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
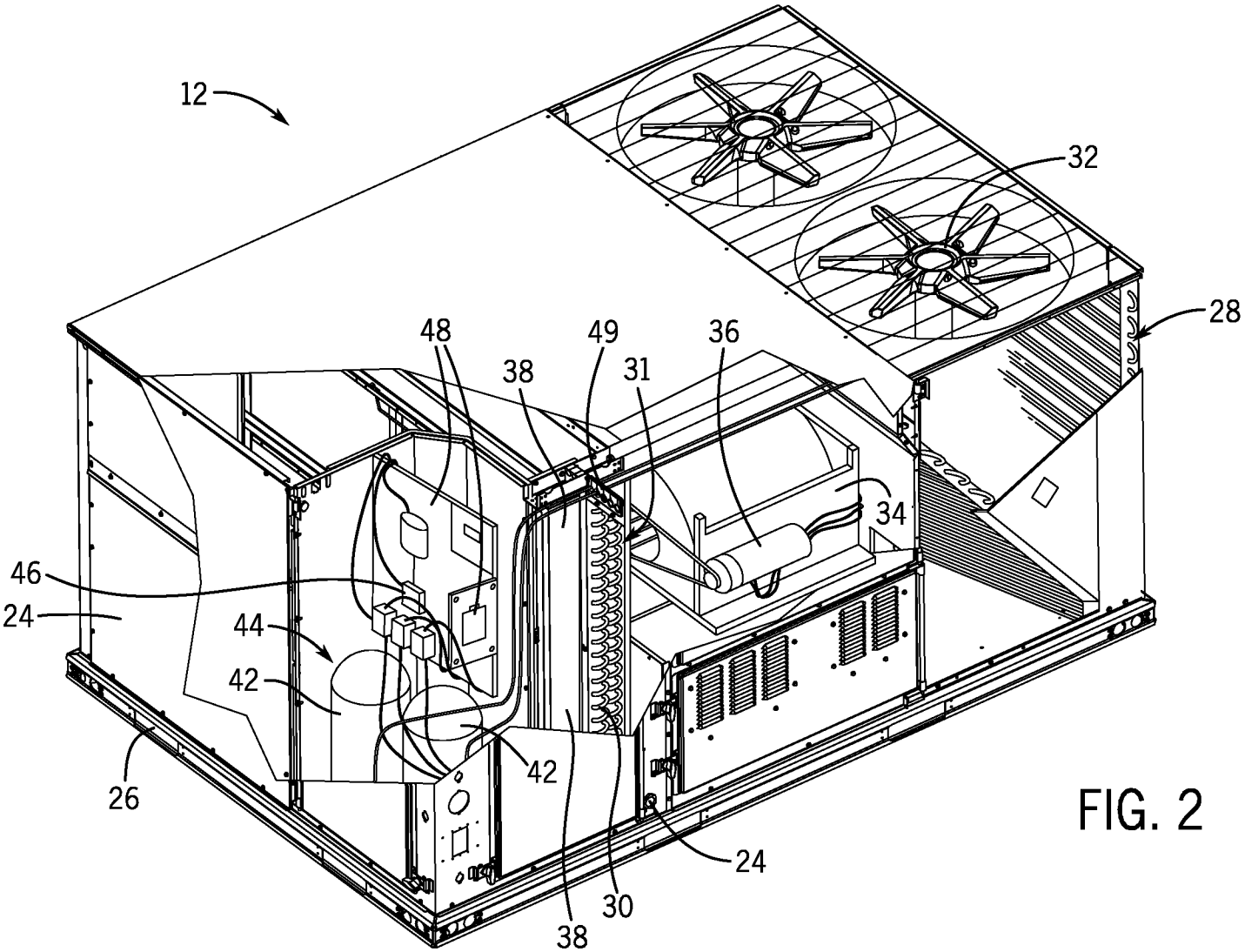
FIG. 2 is a perspective view of an embodiment of an HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
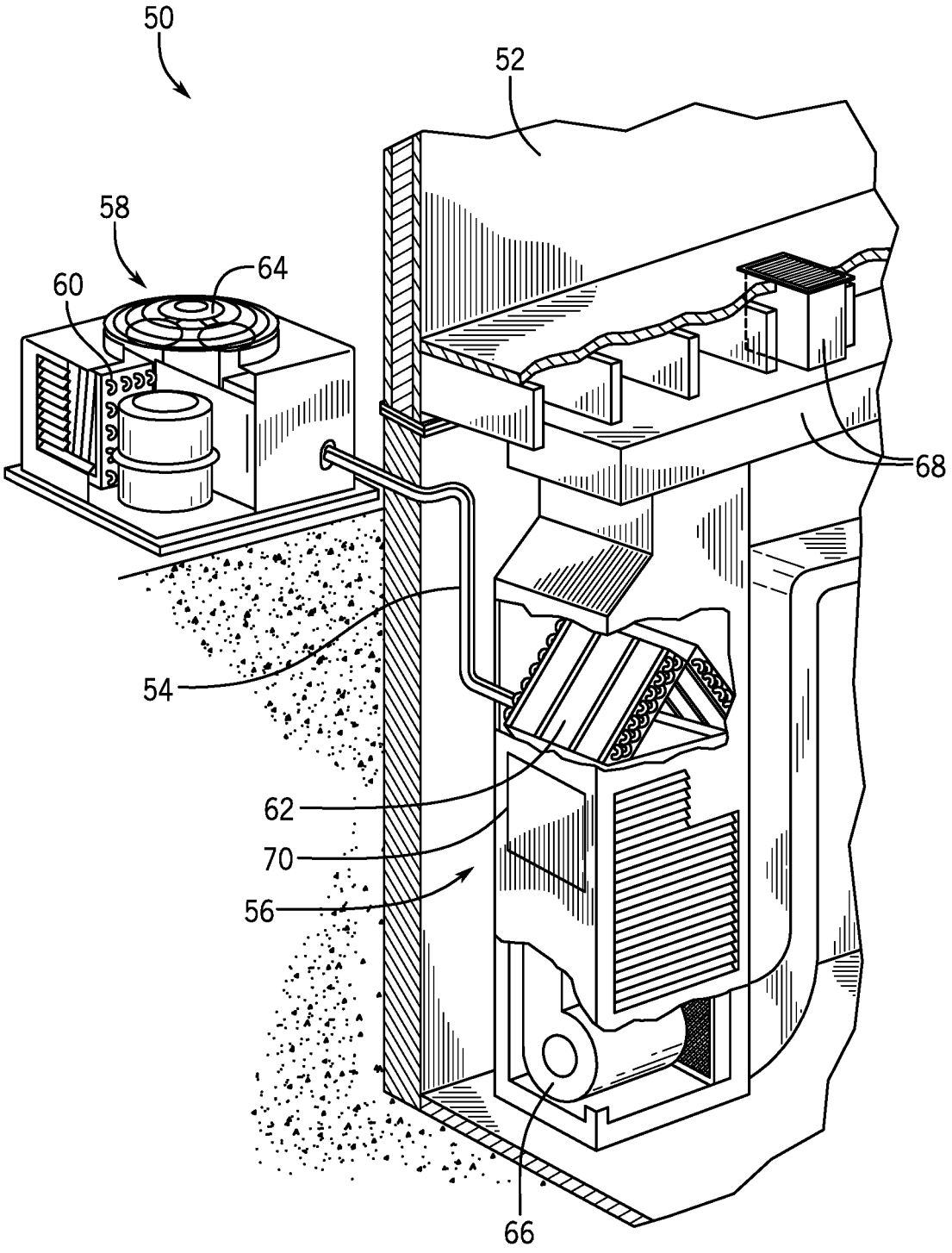
FIG. 3 is a cutaway, perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
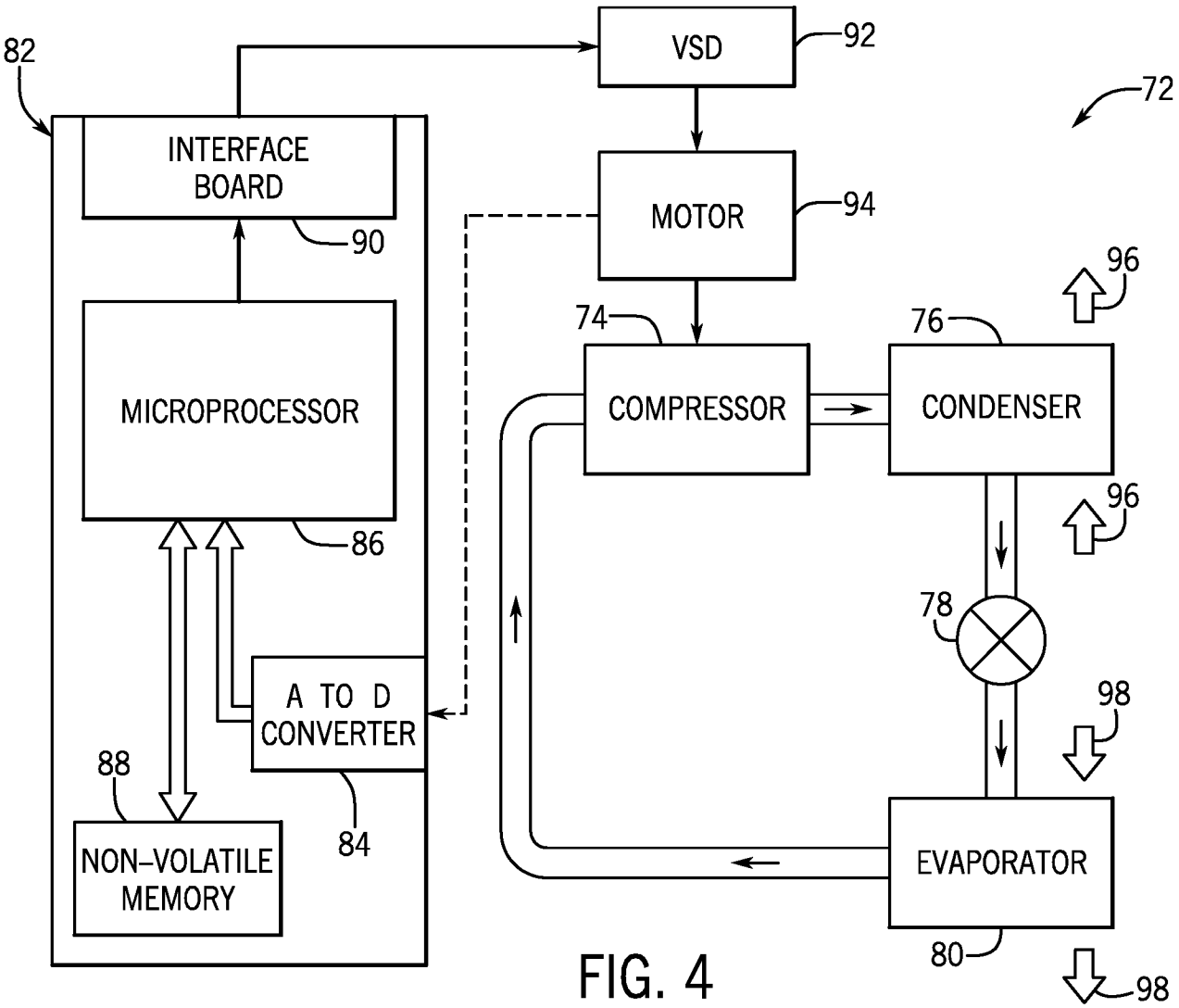
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to a heater assembly having a configuration that enables increased stability of the heater assembly during transit. The heater assembly may include a heater having a plurality of heating elements in a frame that has two opposing ends. The heater may be coupled to a controller enclosure formed from a plurality of housing panels that includes end walls and side walls. In some embodiments, the controller enclosure may have two end walls and a plurality of side walls in a polygonal configuration. For example, the polygonal configuration may be non-rectangular. One of the two opposing ends of the frame may be coupled to one of the two end walls such that an orientation of the heating elements may be changed based on respective locations of the plurality of side walls of the controller enclosure.

In a transportation orientation of the heater assembly, the heater of the heater assembly may be positioned parallel or substantially parallel to the ground. For example, the heater assembly may lie substantially flat or horizontally along the ground in a container or on a rack, such that at least a portion of the heater and at least a portion of a side wall of the controller enclosure may contact the ground or other surface supporting the heater assembly in the transportation orientation. In some embodiments, the frame of the heater has a base that is substantially aligned with the side wall of the controller enclosure such that the frame and the side wall may rest on a flat surface. With portions of the heater and the side wall in contact with supporting surfaces during transportation, the center of gravity of the heater assembly may be lowered, as compared to a heater assembly disposed at an oblique angle relative to the ground or other surface during transit. In this way, improved stability of the heater assembly during transportation is enabled and provided.

Figure 5:
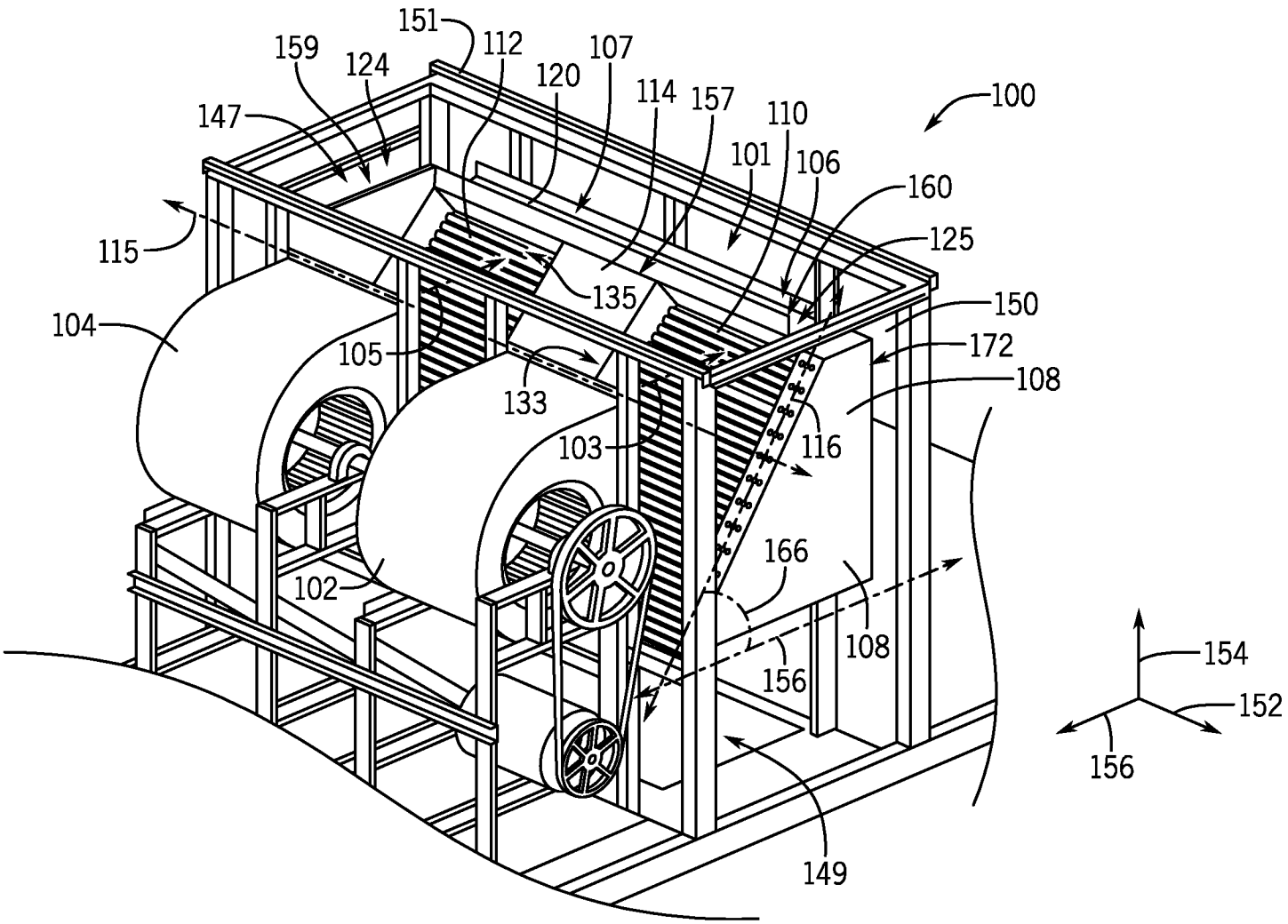
FIG. 5 is a perspective view of an embodiment of a heating unit and a heater assembly disposed within the heating unit in an installed orientation, in accordance with an aspect of the present disclosure.

To facilitate discussion of FIG. 5, a heating unit 100 and its components are described with reference to a longitudinal axis or direction 152, a vertical axis or direction 154, and a lateral axis or direction 156. FIG. 5 is a perspective view of the heating unit 100, which may be incorporated with the HVAC unit 12, such as a rooftop unit (RTU) or a pad mounted unit associated with the building 10, or with any other suitable HVAC system. In the illustrated embodiment, a heater assembly 106 having a heater 107 and a controller enclosure 108 is mounted within the heating unit 100 in an installed orientation 101 of the heater assembly 106. As mentioned above, the heater 107, the controller enclosure 108, and other components may be assembled into the heater assembly 106 at a manufacturing facility. The heater assembly 106 may then be transported to an installation site of the heating unit 100 and installed within the heating unit 100 in the installed orientation 101. During transit to the installation site, the heater assembly 106 may be disposed in a transportation orientation, for example, within a container or on a rack. Additional details with regard to the transportation orientation are discussed herein with reference to FIGS. 6-8.

Referring back to FIG. 5, the heater 107 has one or more heating elements, such as a first heating coil 110 and a second heating coil 112 separated by a coil divider 114. The first heating coil 110 and the second heating coil 112 may be arranged in a frame 157 of the heater 107 that has two opposing ends 159, 160. For example, the first heating coil portion 110 and the second heating coil portion 112 may be arranged in a planar configuration within the heater 107 that defines a plane 116 extending through the heater 107 along a length 115 of the heater assembly 106 in the longitudinal direction 152. Although the illustrated embodiment depicts the heater 107 as having two heating coils 110, 112 arranged in the planar configuration, it should be understood that the heater 107 may have any other suitable number of heating coils arranged in the planar configuration. For example, the heater 107 may have one heating coil, three heating coils, four heating coils, or more heating coils. In some embodiments, the heater assembly 106 may be an electric heater assembly, and the first heating coil 110 and the second heating coil 112 may generate heat via electricity.

The heater 107 may be mounted to the controller enclosure 108 at a peripheral edge 125 of the heater assembly 106. For example, the controller enclosure 108 may abut the first heating coil 110 of the heater 107. In some embodiments, a first end 160 of the frame 157 is coupled to a recessed portion of an end wall of the controller enclosure 108 such that an orientation of the first heating coil 110 and the second heating coil 112 may change based on the respective locations of side walls of the controller enclosure 108. The operation of the heater assembly 106 may be controlled by processing circuitry within the controller enclosure 108. For example, the processing circuitry within the controller enclosure 108 may regulate the operation, such as a temperature setting, of the first heating coil 110 and the second heating coil 112 to provide heat to respective air flows driven through the first heating coil 110 and the second heating coil 112 before the respective air flows are supplied to the building 10. In some embodiments, the processing circuitry within the controller enclosure 108 may independently control the operation of the first heating coil 110 and the second heating coil 112 to provide heat to the respective air flows driven through the first heating coil 110 and the second heating coil 112. For example, the processing circuity may set a temperature setting of the first heating coil 110 independently of a temperature setting of the second heating coil 112. In other embodiments, the processing circuitry may control the operation of the first heating coil 110 and the second heating coil 112 together to provide heat to the respective air flows driven through the first heating coil 110 and the second heating coil 112.

As mentioned above, the controller enclosure 108 may be formed from a plurality of housing panels. In the illustrated embodiment, for example, the controller enclosure 108 may be formed from seven housing panels. In other embodiments, the controller enclosure 108 may be formed from more or fewer housing panels based on a profile geometry of the controller enclosure 108. In the illustrated embodiment, the controller enclosure 108 has a substantially pentagonal profile geometry. That is, a cross-section of the controller enclosure 108 in the lateral direction 156 may have a substantially pentagonal shape or configuration. However, in other embodiments, the controller enclosure 108 may have other suitable non-rectangular polygonal profiles or configurations. For example, the controller enclosure 108 may have a hexagonal profile or configuration, a heptagonal profile or configuration, an octagonal profile or configuration, a substantially triangular profile or configuration, a substantially equilateral triangular profile or configuration, or the like. Additionally, the housing panels of the controller enclosure 108 may include one or more end walls and one or more side walls in the non-rectangular polygonal configuration. For example, the housing panels may include two end walls and five side walls in the non-rectangular polygonal configuration. Additional details with regard to the housing panels of the controller enclosure 108 is discussed below with reference to FIGS. 6 and 7.

The controller enclosure 108 may also be coupled to a side panel 150 of the heating unit 100. In the illustrated embodiment, the side panel 150 may be positioned within the heating unit 100. For example, the side panel 150 may partially define a compartment within a housing 151 of the heating unit 100. In such embodiments, the controller enclosure 108 may be disposed within the compartment partially defined by the side panel 150 and within the housing 151 of the heating unit 100. In other embodiments, the heater 107 may be mounted within the heating unit 100, such that the controller enclosure 108 is disposed external to the heating unit 100. For example, the side panel 150 may partially define a housing 151 of the heating unit 100. The side panel 150 may partially separate the heater 107 from the controller enclosure 108. That is, other than a portion of the heater 107 that is mounted to the controller enclosure 108 through the side panel 150, other portions of the heater 107 may be disposed internal to the heating unit 100. For example, the first heating coil 110, the second heating coil 112, and the coil divider 114 may be disposed within the heating unit 100 while a portion of the heater 107 extending along the length 115 of the heater assembly 106 at the peripheral edge 125 of the heater assembly 106 may be coupled to the controller enclosure 108 through an opening 172 in the side panel 150.

The heating unit 100 may also include a first blower 102 that directs a first air flow 103 along a first air flow path 133 of the heating unit 100 toward the first heating coil 110 and a second blower 104 that directs a second air flow 105 along a second air flow path 135 of the heating unit 100 toward the second heating coil 112. In some embodiments, the first blower 102 and the second blower 104 may operate concurrently. For example, the first blower 102 may direct the first air flow 103 along the first air flow path 133 and the second blower 104 may direct the second air flow 105 along the second air flow path 135, concurrently. In other embodiments, the first blower 102 and the second blower 104 may operate at different times. For example, the first blower 102 may direct the first air flow 103 along the first air flow path 133 and the second blower 104 may direct the second air flow 105 along the second air flow path 135 during different periods of time.

The heater assembly 106 may be coupled to a mounting rail 120 that extends along the length 115 of the heating unit 100 in the longitudinal direction 152. In the installed orientation, the heater assembly 106 may be positioned at an oblique angle 166 relative to the lateral direction 156 along which the first air flow path 133 and the second air flow path 135 extend through the heating unit 100. That is, the plane 116 defining the planar configuration of the first heating coil 110 and the second heating coil 112 of the heater assembly 106 may be positioned at the oblique angle 166 relative to the first air flow path 133 and the second air flow path 135 extending into the heating unit 100. For example, the oblique angle 166 may be greater than five degrees, ten degrees, fifteen degrees, twenty degrees, thirty degrees, or any other suitable angle relative to the first air flow path 133 or the second air flow path 135 to facilitate conditioning of the first air flow 103 along the first air flow path 133 through the heating unit 100, conditioning of the second air flow 105 along the second air flow path 135 through the heating unit 100, or both.

In some embodiments, the heating unit 100 may have a downward discharge configuration or a side discharge configuration. In the downward discharge configuration, the heating unit 100 may include a side panel installed in the heating unit 100 at a peripheral edge 124 of the heater assembly 106. The heating unit 100 may direct the first air flow 103 and the second air flow 105 toward a base outlet 149 of the heating unit 100 below the heater assembly 106. In one embodiment, the heating unit 100 may have the downward discharge configuration in an implementation with a rooftop unit (RTU) associated with the building 10. In the side discharge configuration, the heating unit 100 may include a base panel installed in the heating unit 100 below the heater assembly 106. The heating unit 100 may direct the first air flow 103 and the second air flow 105 toward a side outlet 147 at the peripheral edge 124 of the heating unit 100. In one embodiment, the heating unit 100 may have the side discharge configuration in an implementation with a pad mounted unit associated with the building 10.

Figure 6:
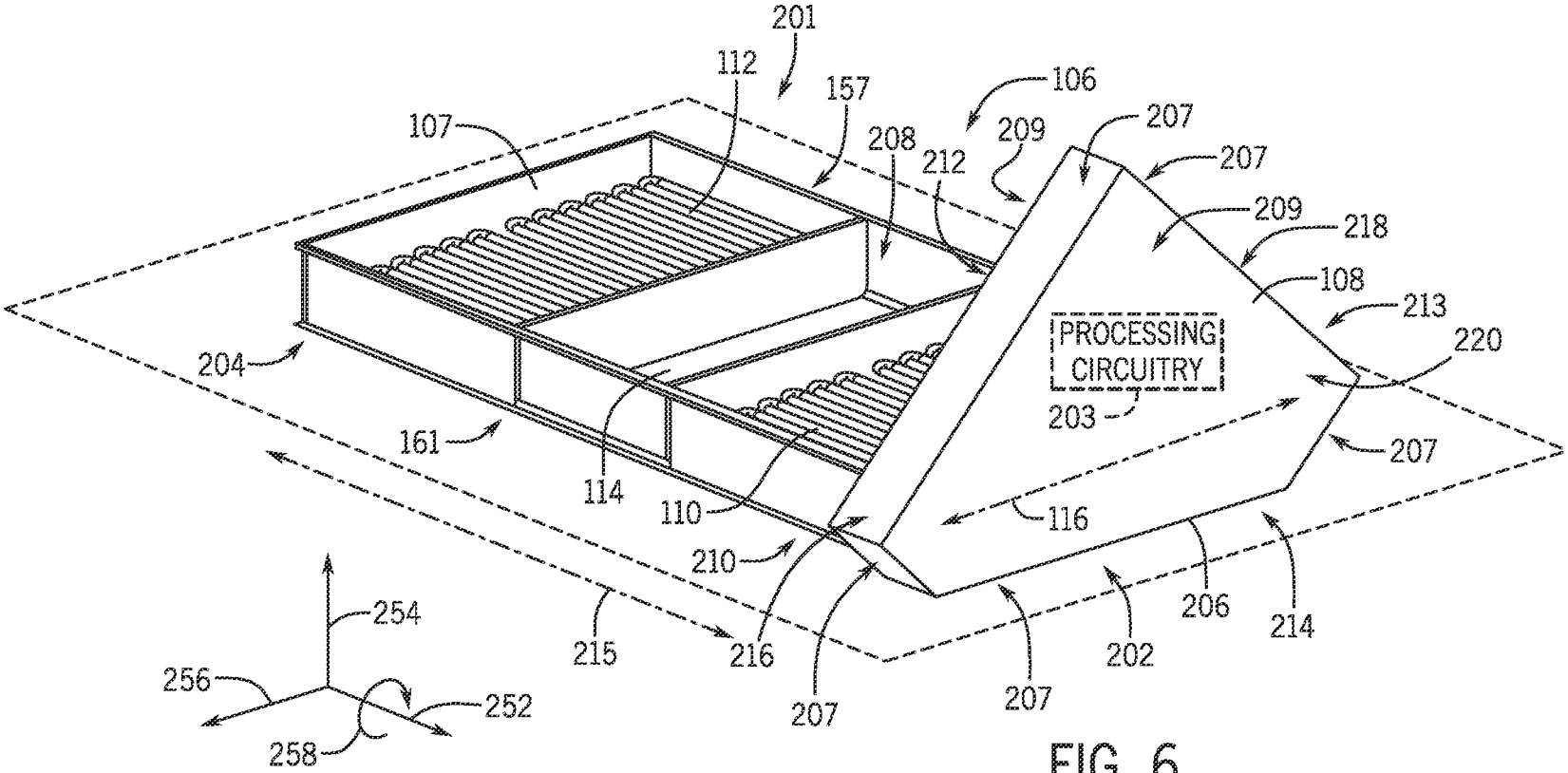
FIG. 6 is a perspective view of an embodiment of the heating assembly of FIG. 5 in a transportation orientation, in accordance with an aspect of the present disclosure.

To facilitate discussion of FIGS. 6-8, the heater assembly 106 and its components are described with reference to a longitudinal axis or direction 252, a vertical axis or direction 254, and a lateral axis or direction 256. As described above, the heater assembly 106 may be disposed in a transportation orientation during transit of the heater assembly 106 to the installation site of the heating unit 100 or to another location. FIG. 6 is a perspective view of an embodiment of the heater assembly 106 having the heater 107 and the controller enclosure 108 in a transportation orientation 201. In the illustrated embodiment, the controller enclosure 108 houses the processing circuitry 203 within the controller enclosure 108. For example, the processing circuitry 203 may be positioned within two end walls 209 and five side walls 207 of the controller enclosure 108. In contrast to the installed orientation 101 of the heater assembly 106 described above, the heater assembly 106 may be positioned parallel or substantially parallel to a ground 202 or other surface in the transportation orientation 201 of the heater assembly 106. For example, a plane 116 defined by the planar configuration of the first heating coil 110 and the second heating coil 112 of the heater 107 may be positioned parallel or substantially parallel to the ground 202. That is, the heater assembly 106 may lie substantially flat or horizontally along the ground 202 or other supporting surface in the transportation orientation 201. In the illustrated embodiment, at least a portion 204 of the heater 107, such as a base 161 of the frame 157, along a length 215 of the heater 107 in the longitudinal direction 252 and a base 206 of the controller enclosure 108 may contact the ground 202 or other surface supporting the heater assembly 106. For example, the base 161 of the frame 157 may be substantially aligned with the base 206 of the controller enclosure 108 such that the frame 157 and the base 206 of the controller enclosure are configured to rest on a flat surface or other supporting surface for shipping or storage purposes. In this way, the center of gravity of the heater assembly 106 may be lower, as compared to the heater assembly 106 being disposed at an oblique angle relative to the ground 202 or other surface beneath the heater assembly 106, in the transportation orientation 201, thereby providing more stability for the heater assembly 106 in the transportation orientation 201.

The heater assembly 106 may be reoriented from the transportation orientation 201 to the installed orientation 101 by rotating the heater assembly 106 in a rotational direction about the longitudinal axis 252 of the heater assembly 106. In the transportation orientation 201, an air flow-discharging side 208 of the heater assembly 106 may face upwards, relative to the vertical axis 254, and an air flow-receiving side 210 of the heater assembly 106 may face the ground 202 or other supporting surface. The heater assembly 106 may be oriented in the installed orientation 101 by rotating the heater assembly 106 in either a clockwise direction 258 or a counter-clockwise direction about the longitudinal axis 252 of the heater assembly 106, such that the air flow-discharging side 208 is angled downwards, relative to the vertical axis 254, and the air flow-receiving side 210 is angled upwards, relative to the vertical axis 254. As such, the heater assembly 106 may be easily reoriented for installation in the heating unit 100 after transportation to the installation site of the heating unit 100 is completed. In some embodiments, side walls 207 of the controller enclosure 108 maybe positioned or located such that the first heating coil portion 110 and the second heating coil portion 112 are angled relative to a flow of air in the heating unit 100 after the heater assembly 106 is installed in the heating unit 100. For example, the first heating coil portion 110 and the second heating coil portion 112 are angled such that a side wall 213 of the controller enclosure 108 is located substantially horizontal relative to a resting surface of the heating unit 100.

As mentioned above, the controller enclosure 108 may be formed from a plurality of housing panels. FIG. 7 is a front view of an embodiment of the controller enclosure 108 of the heating assembly 106 in the transportation orientation 201. In the illustrated embodiment, the controller enclosure 108 has a substantially pentagonal profile geometry and is formed from seven housing panels, such as two end walls and five side walls. However, in other embodiments, the controller enclosure 108 may have more or fewer housing panels based on the manufacturing process of the controller enclosure 108 and other design considerations. For example, two or more of the housing panels may be integrally formed, such that the controller enclosure 108 has a pentagonal profile geometry with less than seven housing panels.

Figure 7:
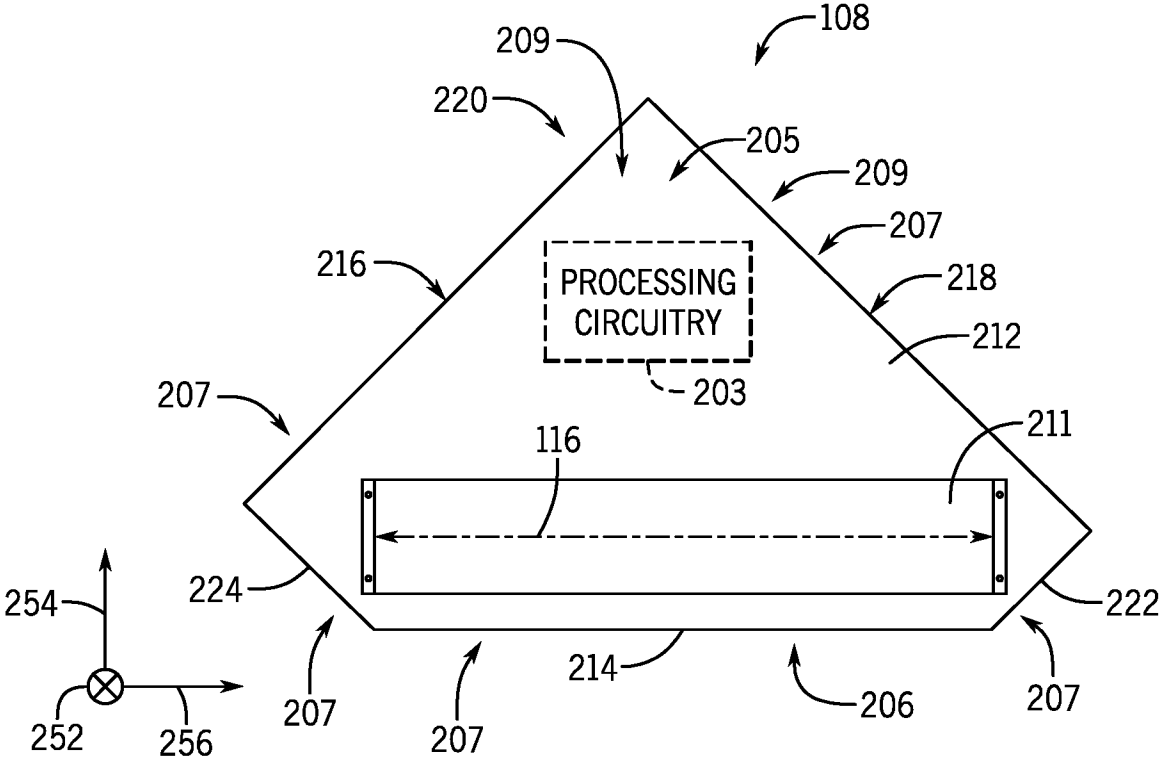
FIG. 7 is a front view of an embodiment of the controller enclosure of the heating assembly of FIG. 5 in the transportation orientation, in accordance with an aspect of the present disclosure.

Referring now to FIG. 7, a first housing panel 212 of the plurality of housing panels may be configured to abut an end of the heater 107 and extend transverse to the plane 116 defined by the planar configuration of the first heating coil 110 and the second heating coil 112 of the heater 107. In some embodiments, the first housing panel 212 has a substantially pentagonal profile geometry. A recessed portion 211 of the first housing panel 212 may be configured to couple to the end of the heater 107. For example, an end portion of the heater 107 may be fixed within the recessed portion 211 of the first housing panel 212 during assembly of the heater assembly 106. A second housing panel 214 of the plurality of housing panels may extend adjacent to and along the plane 116. In the transportation orientation 201 of the heater assembly 106, the second housing panel 214 may act as the base 206 of the controller enclosure 108. In some embodiments, the second housing panel 214 has a substantially rectangular profile geometry. Additionally, in the illustrated embodiment, the first housing panel 212 and the second housing panel 214 are two end walls 209 of the controller enclosure 108.

A third housing panel 216 and a fourth housing panel 218 of the plurality of housing panels may extend transverse to both the plane 116 and the first housing panel 212 and may couple to one another and the first housing panel 212. In some embodiments, the third housing panel 216 and the fourth housing panel 218 may have substantially rectangular profile geometries. A fifth housing panel 220 of the plurality of housing panels may also extend transverse to the plane 116 and extend substantially parallel to the first housing panel 212. In some embodiments, the fifth housing panel 220 may have a substantially pentagonal profile geometry. The first housing panel 212 and the fifth housing panel 220 may be separated by a width of the controller enclosure 108 extending in the longitudinal direction 252. The width of the controller enclosure 108 may define an interior compartment 205 for housing the processing circuitry 203, electronic circuitry, and other suitable components within the controller enclosure 108. A sixth housing panel 222 and a seventh housing panel 224 of the plurality of housing panels may extend transverse to the plane 116, the first housing panel 212, and the fifth housing panel 220 and may couple to the first housing panel 212 and the fifth housing panel 220. In some embodiments, the sixth housing panel 222 and the seventh housing panel 224 may have substantially rectangular profile geometries. However, unlike the third housing panel 216 and the fourth housing panel 218, the sixth housing panel 222 and the seventh housing panel 224 may not couple to one another. Additionally, in the illustrated embodiment, the third housing panel 216, the fourth housing panel 218, the fifth housing panel 220, the sixth housing panel 222, and the seventh housing panel 224 are side walls 207 of the controller enclosure 108.

Before, during, or after transit of one or more heater assemblies 106 from a manufacturing facility to an installation site, the heater assemblies 106 may be stored on one or more storage racks. FIG. 8 is a perspective view of an embodiment of a plurality of heater assemblies 106 in respective transportation orientations 201 on a plurality of stacking racks 232 that may facilitate more efficient storage or transportation of the plurality of heater assemblies 106. For example, the plurality of stacking racks 232 may be located in a warehouse 230 or other suitable storage facility. Although each storage rack 232 has five support shelves 234 for respective heater assemblies 106 in the illustrated embodiment, it should be understood that, in other embodiments, each storage rack 232 may have more or fewer support shelves 234 for storing respective heater assemblies 106.

Figure 8:
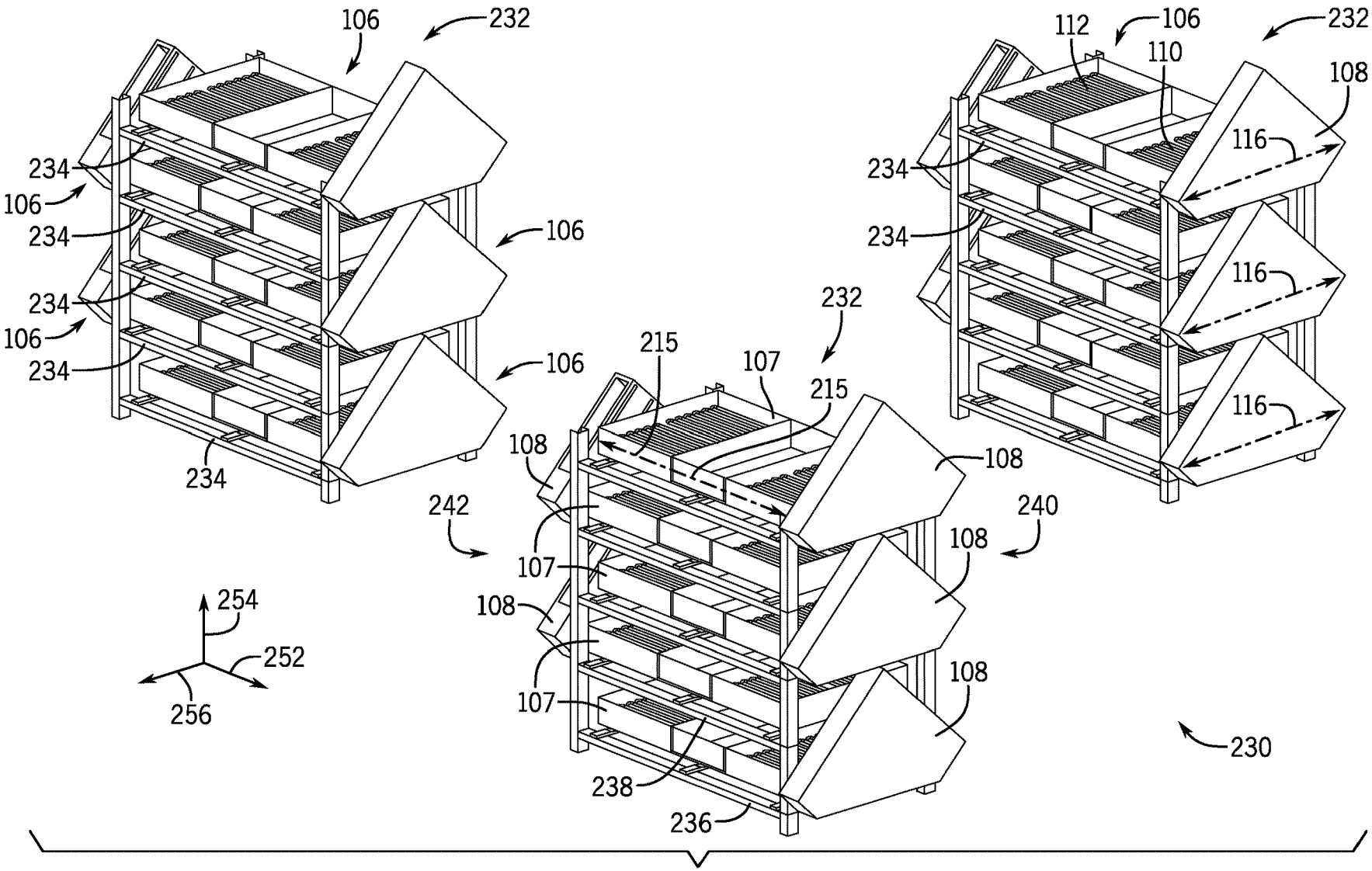
FIG. 8 is a perspective view of an embodiment of a plurality of heater assemblies in respective transportation orientations, in accordance with an aspect of the present disclosure.

Referring now to FIG. 8, each support shelf 234 may store one of the heater assemblies 106 in the transportation orientation 201. The heater assemblies 106 on the support shelves 234 may be positioned parallel or substantially parallel to the support shelves 234 in the transportation orientation 201 of each heater assembly 106. For example, the plane 116 defined by the planar configuration of the first heating coil 110 and the second heating coil 112 of the heater 107 may be positioned parallel or substantially parallel to the support shelves 234. That is, each heater assembly 106 may lie substantially flat or horizontally on one of the support shelves 234 of one of the storage racks 232. Additionally, each heater assembly 106 on a respective storage shelf 234 may be positioned parallel or substantially parallel to other heater assemblies 106 on the storage rack 232 having the respective storage shelf 234. For example, the heaters 107 of the heater assemblies 106 on one of the storage racks 232 may be aligned in the vertical direction 254.

To improve the storage efficiency of the heater assemblies 106 on the storage racks 232, the heater assemblies 106 may be positioned in alternating orientations of the transportation orientation 201. In the illustrated embodiment, for example, the heater assembly 106 positioned on a first support shelf 236 may have an opposite orientation to the heater assembly 106 positioned on a second support shelf 238 adjacent to the first support shelf 236. That is, the heater assembly 106 on the first support shelf 236 may be positioned in the transportation orientation 201 with the controller enclosure 108 proximate to a first side 240 of the storage rack 232 with the heater 107 extending in the longitudinal direction 252 along the length 215 of the heater 107 toward a second side 242 of the storage rack 232. In contrast, the heater assembly 106 on the second support shelf 238 may be positioned in the transportation orientation 201 with the controller enclosure 108 proximate to the second side 242 of the storage rack 232 with the heater 107 extending in the longitudinal direction 252 along the length 215 of the heater 107 toward the first side 240 of the storage rack 232. In this way, the heater assemblies 106 may be stored in alternating transportation orientations 201 on adjacent support shelves 234 of each support rack 232, thereby reducing an amount of unutilized space for storing the heater assemblies 106 on each support rack 232.

As set forth above, embodiments of the present disclosure may provide one or more technical effects useful in providing more stability to a heater assembly during transit of the heater assembly to an installation site of a heating unit or another location. For example, embodiments of the present disclosure are directed to an improved heater assembly that may include a heater having a plurality of heating elements in a planar configuration. The heater may be coupled to a controller enclosure formed from a plurality of housing panels. In some embodiments, the controller enclosure may be formed from seven housing panels. A first housing panel of the plurality of housing panels may abut an end of the heater and extend transverse to a plane defined by the planar configuration of the plurality of heating elements, and a second housing panel of the plurality of housing panels may extend adjacent to and along the plane. As such, the heater of the heater assembly may be positioned parallel or substantially parallel to the ground in a transportation orientation of the heater assembly. For example, the heater assembly may lie substantially flat or horizontally on the ground in a container or on a rack, such that at least a portion of the heater and/or at least a portion of the second housing panel may contact the ground or other surface supporting the heater assembly in the transportation orientation. In this way, the transportation orientation of the heater assembly may provide more stability to the heater assembly during transit by lowering the center of gravity of the heater assembly as compared to a heater assembly disposed at an oblique angle relative to the ground or other surface supporting the heater assembly.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heater assembly for a heating, ventilation, and/or air conditioning (HVAC) system, comprising:

a heater having a plurality of heating elements arrayed in a common plane within a frame, the frame having two opposing ends; and a controller enclosure comprising a first end wall and a second end wall, each having a non-rectangular, polygonal configuration, and a plurality of side walls extending from the first end wall to the second end wall, wherein one of the two opposing ends of the frame is coupled to the first end wall, wherein at least one side wall of the plurality of side walls extends obliquely to the common plane, and wherein the first end wall, the second end wall, and the plurality of side walls define an interior compartment of the controller enclosure, wherein the heater assembly is adjustable between a transportation orientation and an installed orientation, wherein, in the transportation orientation, the frame and a first side wall of the plurality of side walls extend along a horizontal direction, such that the common plane defined by the plurality of heating elements extends horizontally, and wherein, in the installed orientation, a second side wall of the plurality of side walls extends in the horizontal direction, and the frame and the first side wall are disposed at an oblique angle relative to the horizontal direction, such that the common plane defined by the plurality of heating elements is disposed at the oblique angle.

2. The heater assembly of claim 1, wherein the non-rectangular, polygonal configuration of the controller enclosure is triangular.

3. The heater assembly of claim 1, wherein the non-rectangular, polygonal configuration of the controller enclosure is pentagonal.

4. The heater assembly of claim 1, wherein the plurality of side walls includes five side walls in the non-rectangular, polygonal configuration.

5. The heater assembly of claim 1, wherein the frame has a base that is aligned with the first side wall of the plurality of side walls of the controller enclosure such that the frame, the base, and the first side wall of the plurality of side walls are configured to extend in the horizontal direction in the transportation orientation.

6. The heater assembly of claim 5, wherein, in the installed orientation, the plurality of side walls of the controller enclosure is positioned such that the plurality of heating elements is angled relative to the horizontal direction and relative to a flow of air in the HVAC system.

7. The heater assembly of claim 1, wherein the heater and the controller enclosure are configured to jointly transition between the transportation orientation and the installed orientation.

8. The heater assembly of claim 1, comprising processing circuitry configured to control operation of the plurality of heating elements, wherein the processing circuitry is housed within the interior compartment of the controller enclosure.

9. The heater assembly of claim 1, wherein each side wall of the plurality of side walls is a flat panel.

10. A heater assembly for a heating, ventilation, and/or air conditioning (HVAC) system, comprising:

a heater having a plurality of heating elements arrayed in a common plane within a frame, the frame having two opposing ends; and a controller enclosure comprising two end walls, each having a non-rectangular, polygonal configuration, and a plurality of side walls extending from and between the two end walls, wherein one of the two opposing ends of the frame is coupled to one of the two end walls, wherein at least one side wall of the plurality of side walls extends obliquely to the common plane, and wherein the two end walls and the plurality of side walls define an interior compartment of the controller enclosure;

wherein the heater assembly is adjustable between a transportation orientation and an installed orientation, wherein the frame has a base that is aligned with a first side wall of the plurality of side walls of the controller enclosure, wherein, in the transportation orientation, the base and the first side wall extend in a horizontal direction along an axis, and wherein, in the installed orientation, a second side wall of the plurality of side walls extends in the horizontal direction along the axis, and the base and the first side wall are disposed at an oblique angle relative to the horizontal direction along the axis.

11. The heater assembly of claim 10, wherein the non-rectangular, polygonal configuration of the controller enclosure is triangular.

12. The heater assembly of claim 10, wherein the non-rectangular polygonal configuration of the controller enclosure is pentagonal.

13. The heater assembly of claim 10, wherein the one of the two opposing ends of the frame is coupled to a recessed portion of the one of the two end walls.

14. The heater assembly of claim 10, comprising processing circuitry positioned within the interior compartment of the controller enclosure, wherein the processing circuitry is configured to supply power to the heater.

15. The heater assembly of claim 10, wherein the second side wall of the plurality of side walls and a third side wall of the plurality of side walls are coupled to one another, and wherein the second side wall and the third side wall each extend transverse to the first side wall.

16. The heater assembly of claim 10, wherein the second side wall of the plurality of side walls and a third side wall of the plurality of side walls are not coupled to one another, and wherein the second side wall and the third side wall each extend transverse to the first side wall.

17. A heater assembly for a heating, ventilation, and/or air conditioning (HVAC) system, comprising:

a heater having a plurality of heating elements arrayed in a common plane within a frame having two opposing ends; and a controller enclosure having two end walls with a non-rectangular, polygonal configuration, and a plurality of side walls extending from and between the two end walls, wherein one of the two opposing ends of the frame is coupled to one of the two end walls, a first side wall of the plurality of side walls extends along the common plane and is a base of the controller enclosure, at least a second side wall and a third side wall of the plurality of side walls extend transverse to the first side wall and obliquely to the common plane, and the two end walls and the plurality of side walls define an interior compartment of the controller enclosure, wherein the heater assembly is adjustable between a transportation orientation and an installed orientation, wherein, in the transportation orientation, the frame and the first side wall of the plurality of side walls extend along an axis in a horizontal direction, and wherein, in the installed orientation, the second side wall extends along the axis in the horizontal direction, and the frame and the first side wall are configured to be disposed at an oblique angle relative to the axis extending in the horizontal direction.

18. The heater assembly of claim 17, wherein the non-rectangular, polygonal configuration of the controller enclosure is triangular.

19. The heater assembly of claim 17, wherein the non-rectangular, polygonal configuration of the controller enclosure is an equilateral triangle.

20. The heater assembly of claim 17, wherein the non-rectangular, polygonal configuration of the controller enclosure is pentagonal.

21. The heater assembly of claim 17, comprising processing circuitry disposed within the interior compartment, wherein the processing circuitry is configured to supply power to the heater.

22. The heater assembly of claim 17, wherein the plurality of side walls of the controller enclosure is positioned in the installed orientation of the heater assembly such that the plurality of heating elements is angled relative to a flow of air in [[an]]the HVAC system.

23. The heater assembly of claim 17, wherein the frame and the first side wall of the plurality of side walls are configured to rest on a surface supporting the heater assembly in the transportation orientation of the heater assembly.

* * * * *